United States Patent [19]

Murakami

[11] Patent Number: 4,564,413

[45] Date of Patent: Jan. 14, 1986

[54] SHEET SPLICER

[75] Inventor: Tamotsu Murakami, Mishima, Japan

[73] Assignee: Shizuoka Kogyo Company, Ltd., Fuji, Japan

[21] Appl. No.: 616,242

[22] Filed: Jun. 1, 1984

[30] Foreign Application Priority Data

Sep. 27, 1983 [JP] Japan ..... 58-177008

[51] Int. Cl.[4] ..... B65H 19/18; B65H 19/20

[52] U.S. Cl. ..... 156/504; 156/505; 242/56 R; 242/58.1; 242/58.4; 242/58.5

[58] Field of Search ..... 156/157, 159, 502, 504, 156/505; 242/56 R, 58.1, 58.4, 58.5

[56] References Cited

U.S. PATENT DOCUMENTS

| | | | |
|---|---|---|---|
| 3,974,490 | 8/1976 | Mori | 242/58.1 |
| 4,100,012 | 7/1978 | Meihofer et al. | 156/505 |
| 4,346,853 | 8/1982 | Stefanoni et al. | 156/504 |

*Primary Examiner*—Michael Wityshyn

*Attorney, Agent, or Firm*—Schwartz & Weinrieb

[57] ABSTRACT

A sheet splicer comprises two sheet roll support means, a table disposed above the sheet rolls held in place on the sheet roll support means and adapted to reciprocate above the table, and sheet guiding means disposed above the belt and adapted to reciprocate between the front and rear ends of the belt. While the sheet from the first sheet roll is being pulled out over the sheet guiding means positioned beforehand at one end of the belt, the leading end of the sheet from the second sheet roll is covered with an adhesive agent and held in place at a prescribed position on the belt at the other end thereof. As the sheet from the first sheet roll is completely drawn out of the sheet roll, the trailing end of this sheet is retained at that position and the sheet guiding means is moved to the other end of the belt. Consequently, the leading end of the sheet from the second sheet roll is allowed to be joined to the trailing end of the sheet. The splicer, accordingly, permits continuous supply of the sheet to a machine used for processing or treating the sheet.

20 Claims, 12 Drawing Figures

SHEET SPLICER

FIELD OF THE INVENTION

This invention relates to a sheet splicer which permits the trailing end of a sheet departing from a spent sheet roll to be automatically joined to the leading end of a sheet unwound from a fresh sheet roll. More particularly, this invention relates to a sheet splicer which enables the trailing end of a sheet departing from a sheet roll of paper or some other substance to be joined to the leading end of a sheet unwound from a freshly supplied sheet roll, thereby allowing the machine used for a printing, laminating or coating operation to be fed with the sheet continuously.

BACKGROUND OF THE INVENTION

In a printing system such as a rotary press, a device for laminating or coating a sheet material, or a device for the production of a corrugated sheet for use in corrugated cardboard, there is adopted a sheet rewinder which unwinds a sheet of paper, for example, as a raw material for the aforementioned device from a sheet roll keeping the sheet in a rolled form thereon and feeds it to the aforementioned device.

In the rewinder of the kind described above, at least one sheet roll is mounted in place as a standby besides the sheet roll currently in use for the purpose of improving the operational efficiency of the rewinder. As the sheet unwound from the sheet roll to undergo the desired treatment is exhausted, the other sheet roll standing by is set rotating to pay off a fresh sheet. Generally, it has been customary to stop the rotation of the old sheet roll as the supply of the sheet from this sheet roll approaches its end, sever the sheet from the sheet roll by inserting a cut near the trailing end of the sheet, and join the cut end of the former sheet to the leading end of the sheet unwound from the new sheet roll. A splicer used for joining the trailing end of the sheet from the old sheet roll to the leading end of the sheet from the new sheet roll without interrupting the operation of the printing system or the corrugator or some other sheet-fabricating device has been known to the art. The conventional sheet splicer necessitates provision of accumulator rolls (dancer rolls). It is so complicated in construction that the operator is compelled to guide the sheet in a zigzag path through rolls while passing the leading end of a sheet paid off a new sheet roll. This work requires much time and labor.

OBJECT OF THE INVENTION

An object of this invention is to provide, for use in a sheet rewinder employed in any of various sheet-fabricating devices, a sheet splicer which enables the trailing end or cut end of a sheet departing from a spent sheet roll to be automatically joined efficiently and rapidly to the leading end of a sheet unwound from a new sheet roll when the sheet roll unwinding work is switched from one of a plurality of sheet rolls mounted in place on the sheet rewinder to another sheet roll freely selected from the remaining sheet rolls standing by.

SUMMARY OF THE INVENTION

The object described above is accomplished by this invention by providing a sheet splicer which comprises in combination two support means rotatably supporting sheet rolls thereon, a table disposed above the space embracing and intervening between the two sheet rolls, a belt adapted to reciprocate in an upper zone along the upper surface of the table, and a sheet guiding means capable of reciprocating in parallel to the upper side of the aforementioned upper zone, selectively assuming positions above the sheet rolls.

While the sheet unwound from one of the sheet rolls is undergoing a given treatment, the leading end of the sheet from the other sheet roll standing by is spread with adhesive agent and disposed at a prescribed position in the upper zone of the belt on top of the table. When the amount of the sheet remaining on the sheet roll currently in motion decreases to a certain extent, the motion of the sheet roll is stopped and the sheet unwound from this sheet roll is cut with a cutter, and the cut end of the sheet is moved in the upper zone of the belt in the direction of the unwinding side. Consequently, the leading end of the sheet standing by in the upper zone comes into contact with the neighborhood of the cut end of the unwound sheet, with the result that the trailing end of the sheet from the spent sheet roll and the leading end of the sheet from the new sheet roll are joined to each other. After this union, the sheet-guiding means is moved in the direction of the sheet roll standing by to start unwinding the sheet from the new sheet roll. The spent sheet roll is replaced with a sheet roll freshly supplied as a standby. By repeating the procedure described above alternately on the two supply rolls, the length of the downtime required for the union of two sheets can be notably shortened and the treatment performed on the sheet can be continued.

As the supply of the sheet from a sheet roll approaches its end, the sheet paid off the sheet roll is generally curled. Possible deficient union of sheets due to the curliness of the sheet can be precluded by providing near each of the sheet rolls a decurler adapted to eliminate the curliness of the sheet.

BRIEF DESCRIPTION OF THE DRAWINGS

The other objects and characteristics of the present invention will become apparent as the further disclosure of the invention is made in the following description of a preferred embodiment with reference to the accompanying drawings, wherein.

DESCRIPTION OF THE PREFERRED EMBODIMENT

Figure 1:
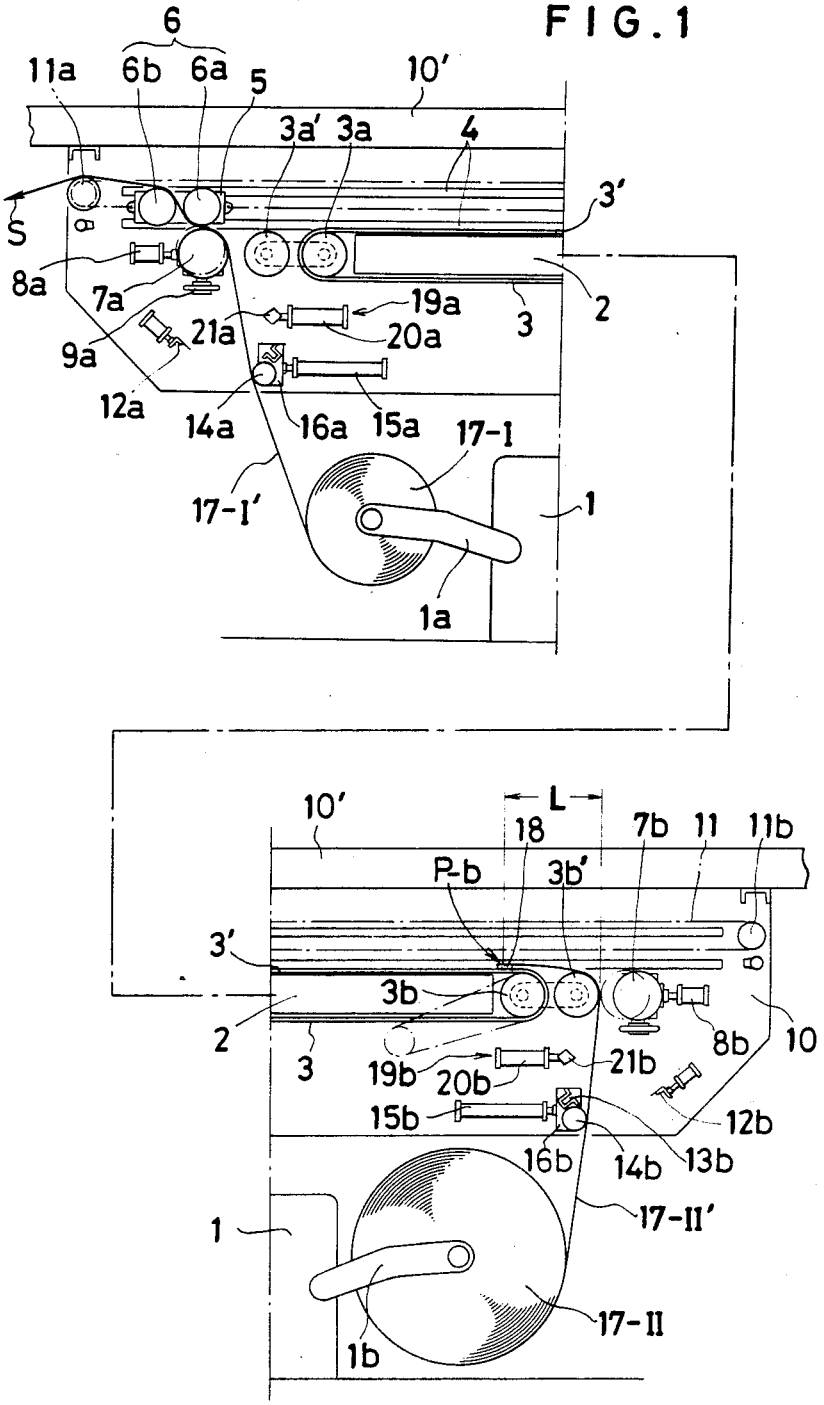
FIG. 1 is a front view of a sheet splicer according to this invention in a condition in which a sheet is drawn out of a lefthand sheet roll (the upside in the drawing) and a righthand sheet roll (the underside in the drawing) is set as a standby.
Figure 4:
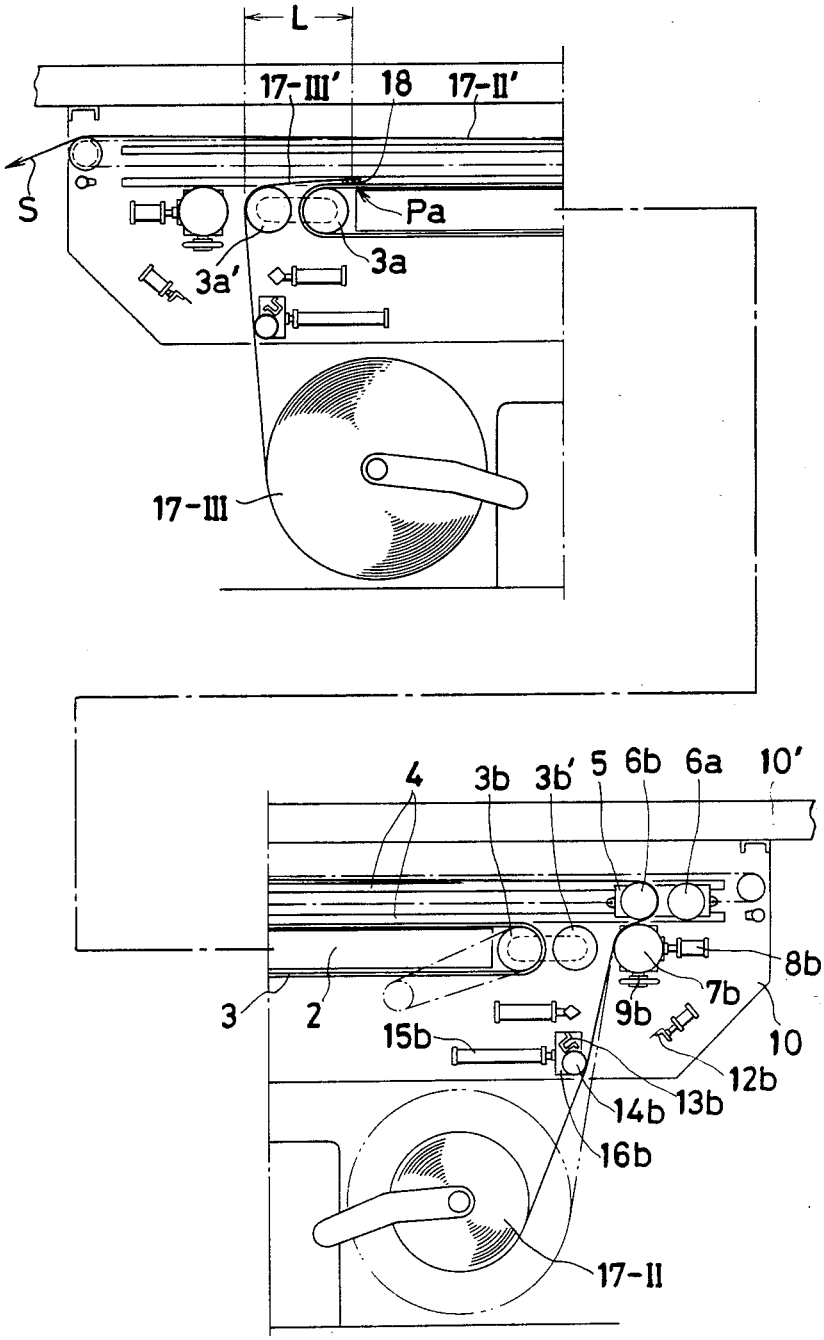
FIG. 4 is a front view of the splicer in a condition in which a sheet is drawn out of the righthand sheet roll after completion of the union of sheets and a lefthand sheet roll is newly set as a standby.
Figure 5:
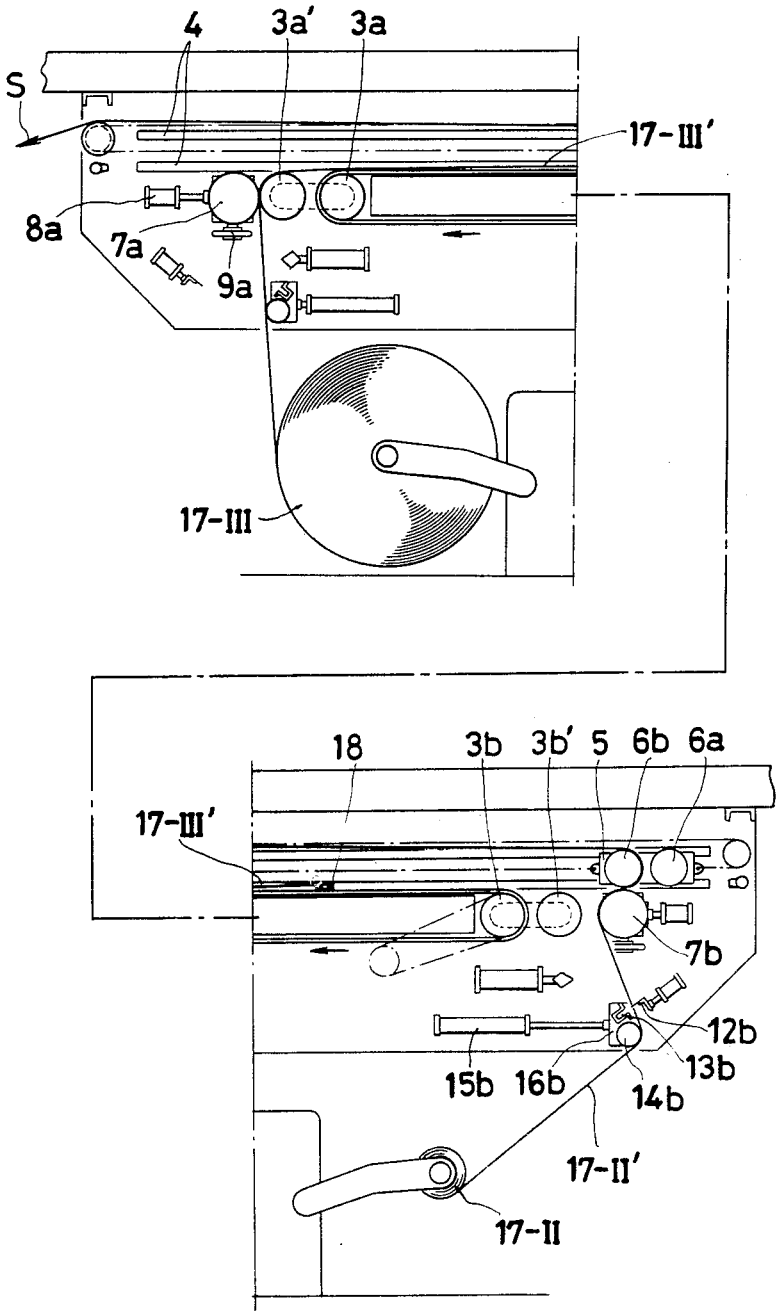
FIG. 5 is a front view of the splicer in a condition in which the operation for union of sheets is just started.

This invention relates to a sheet splicer to be used for providing effective union of sheet ends which is required when continuous supply of a sheet is carried out by switching rewinding operations from one to another of a plurality of sheet rolls. Now, the present invention will be described below with reference to one embodiment illustrated in the accompanying drawings. As a matter of convenience, the sheet splicer of the invention is represented in FIGS. 1, 4 and 5 in such a manner that the lefthand part thereof is illustrated upward and the righthand part thereof is downward.

In the drawings, 1*a* stands for a front support means for a sheet roll and 1*b* for a rear support means for another sheet roll. The front support means 1*a* is situated on the downstream side in the direction of flow of the sheet (indicated by the arrow S) and the rear support means 1*b* on the upstream side. The two support means are depicted as one pair of arms which protrude forwardly and rearwardly respectively from a base 1 installed on the floor. On the free ends of each of the arms, the opposite ends of a spool protruding from the core of the sheet roll are rotatably and detachably supported in place. The disposition of the two support means is not limited to the simultaneous fixation to one common base 1 as depicted. Optionally, the two support means may be independently disposed upon separate support bases on the downstream side and the upstream side in the direction of the flow of the sheet.

A table 2 having a flat upper surface is disposed above the sheet rolls held in place by the two support means 1*a*, 1*b*. Pulleys 3*a*, 3*b* are mounted respectively at the front and rear ends of the table 2. An endless belt 3 is passed over the two pulleys and stretched therebetween so that the lower side of the upper zone 3' of the endless belt 3 will be held in sliding contact with the upper surface of the table 2. One of the pulleys (3*a* or 3*b*) is rotated by a reversible motor and a gearbox. In the illustrated embodiment, rolls 3*a'*, 3*b'* adapted to be interlocked with the pulleys 3*a*, 3*b* are disposed respectively in front of the pulley 3*a* and behind the pulley 3*b*.

Above the lateral sides of the table, rails 4 long enough for their front and rear ends to protrude from the front and rear ends of the table are laid. A pair of laterally opposed trucks 5 are adapted to be reciprocated as guided by the rails. As sheet-guiding means 6, two longitudinally spaced rolls 6*b*, 6*a* are rotatably mounted between the trucks. The lower sides of the two rolls 6*a*, 6*b* are slightly separated upwardly from the upper side of the upper zone of the belt.

As auxiliary guide means for the sheet, a front auxiliary roll 7*a* is disposed in front of the roller 3*a'* and a rear auxiliary roll 7*b* is disposed behind the pulley 3*b'*. The front auxiliary roll 7*a* is moved backwardly by an air cylinder 8*a* and brought into tangential contact with the roller 3*a'*. When the sheet-guiding means 6 is kept at rest at the front ends of the rails, the front auxiliary roll 7*a* is lifted by an air cylinder 9*a* and brought upwardly into tangential contact with the roll 6*a*. Similarly, the rear auxiliary roll 7*b* is moved forwardly by an air cylinder 8*b* and brought into tangential contact with the roller 3*b'*. When the sheet-guiding means 6 is kept at rest at the rear ends of the rails, it is elevated by an air cylinder 9*b*, as seen in FIG. 4, and brought upwardly into tangential contact with the roll 6*b*. The auxiliary rollers 7*a*, 7*b* have their surfaces coated with rubber and the rollers 3*a'*, 3*b'* have their surfaces knurled.

The table 2, the pulleys 3*a*, 3*b* for the belt, the rollers 3*a'*, 3*b'*, the rails 4, and the auxiliary guide means 7*a*, 7*b* are interposed between the laterally opposed stationary side boards 10 hung down in parallel to each other from the upper horizontal beam 10'. Particularly, the auxiliary guide means 7*a*, 7*b* may be provided with frames so adapted that the guide means 7*a*, 7*b* will be moved either in a horizontal direction by cylinders 8*a*, 8*b* fitted with pistons or in a vertical direction by cylinders 9*a*, 9*b*, relative to the stationary side boards 10. These frames are provided with bearings capable of producing motion in opposite directions and auxiliary rolls are mounted between the bearings. When the frames are attached so as to be moved in the horizontal direction relative to the stationary side boards, the cylinders 9*a*, 9*b* fitted with pistons and adapted to move the bearings in the vertical direction relative to the frames are fastened to the frames. When the frames are attached so as to be moved in the vertical direction relative to the stationary side boards, the cylinders 8*a*, 8*b* adapted to move the bearings in the horizontal direction relative to the frames are fastened to the frames. Reciprocation of the sheet-guiding means 6 in the horizontal direction along the rails 4 can be attained, for example, by passing chains 11 around front and rear ratchets 11*a*, 11*b* disposed between the stationary side boards, fastening the opposite ends of the chains to trucks 5 thereby giving rise to endless chains capable of producing cyclic motion along the rails, and allowing one of the ratchets to be rotated by a reversible motor and a gearbox. The lower ends of the stationary side boards are desired to be maintained above the floor so as not to offer any hindrance to the setting and removing of the sheet rolls on the respective support means 1*a*, 1*b*. The horizontal beam 10' is supported by suitable frames on the floor.

Figure 2:
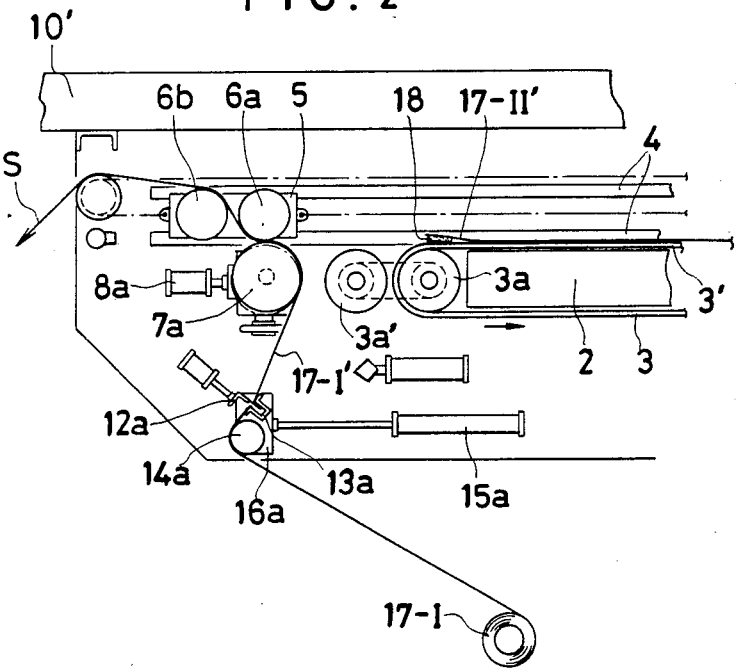
FIGS. 2 and 3 are enlarged front views of an essential part of the splicer, illustrating the sequence of operations for the union of sheets.

In the present embodiment, the sheet from the present sheet roll is cut at a desired position in the direction of width to form a trailing end thereof and the leading end of the sheet from the next sheet roll is joined thereto. To effect this union of the sheet ends, a cutter 12*a* positioned aslant downwardly in the rear direction by an air cylinder is disposed below the auxiliary roll 7*a* of the auxiliary guide means and a cutter 12*b* similarly positioned aslant downwardly in the front direction is disposed below the auxiliary roll 7*b* and, at the same time, a receiving blade 13*a*, as seen in FIG. 2, adapted to cooperate with the aforementioned cutter 12*a* and a blade base 16*a* supporting a roll 14*a* in place and advanced toward the underside of the auxiliary roll 7*a* by an air cylinder 15*a* are disposed below the front end of the table, and a receiving blade 13*b* adapted to cooperate with the cutter 12*b* and a blade base 16*b* supporting a roll 14*b* and advanced toward the underside of the auxiliary roll 7*b* by an air cylinder 15*b* are disposed below the rear end of the table. The horizontal motion of the blade bases 16*a*, 16*b*, of course, can be guided by the stationary side boards 10. For the trailing end of the present sheet to be joined with the leading end of the next sheet with an adhesive tape, the belt 3 is required to be made of a material to which the adhesive layer of the tape does not adhere or to have the surface thereof pretreated with a release agent. For example, a porous belt of polyurethane type resin having its crepe surface treated with tetrafluoroethylene resin may be advantageously used.

FIG. 1 illustrates the splicer in a condition in which a sheet 17-I' is drawn out of a sheet roll 17-I supported by support means 1a. The sheet 17-I' is passed over the roll 14a, and then drawn out past the gaps between the auxiliary roll 7a and the rear roll 6a of the sheet guiding means 6 at the advanced position and between the rear roll 6a and the front roll 6b of the same sheet guiding means 6. While the sheet is being drawn out of the sheet roll 17-I, the next sheet roll 17-II is set in place on the rear support means 1b and the sheet 17-II' is pulled out of the sheet roll 17-II, passed over the roll 14b, and put upon the upper zone 3' of the belt. An adhesive tape such as, for example, a double-faced adhesive tape 18 is attached to the leading end of the sheet and the leading end is positioned at the point P-b separated from the rear end of the upper zone by a distance L. The traveling speed of the belt is regulated so as to be substantially equal to the speed at which the sheet is drawn out of the sheet roll. While the setting of the leading end of the sheet at the position P-b may be accomplished manually, it can be effected mechanically by the operation of the auxiliary roll coupled with the motion of the belt as described more specifically afterward. To join the leading end of the sheet 17-II' from the next sheet roll to the sheet 17-I' of the present sheet roll, a switch for the joining operation on the control panel for the sheet roll 17-II supported in place on the rear support means must be turned ON. Consequently, the rear auxiliary roll 7b advances and presses the sheet 17-II' against the roller 3b' and, at the same time, the belt is set moving so that the upper zone thereof will move forward.

The sheet 17–II' is pressed by the rear auxiliary roll 7b against the roller 3b' and the roller 3b' rotates in conjunction with the pulley, with the result that the sheet 17–II' advances together with the belt, and the sheet roll on the rear support means pays off its sheet.

At this time, the front blade base 16a is also advanced by the air cylinder 15a to transfer the receiving blade 13a to the position opposite the front cutter 12a. When the next sheet 17-II' is advanced to a certain extent by the motion of the belt, the front cutter 12a is thrust in the direction of the receiving blade 13a to cut the present sheet in the direction of width and, at the same time, the front auxiliary roll 7a is elevated to press the present sheet 17-I' against the rear roll 6a of the guiding means (FIG. 2).

Figure 3:
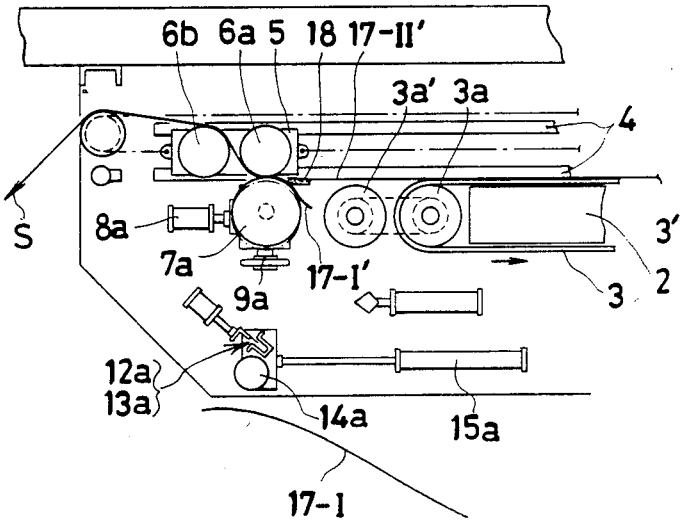

When the trailing end of the present sheet which has been cut by the cutter 12a is on the verge of being drawn in between the front auxiliary roll 7a and the roll 6a, the leading end of the next sheet covered with the adhesive tape 18 and advanced in conjunction with the upper zone of the belt moves over the front end of the upper zone and the roller 3a' and continues its advance and finally adheres to the present sheet through the medium of the adhesive tape 18. As soon as the joint formed by the adhesive tape between the trailing end of the present sheet and the leading end of the next sheet goes past the gap between the front auxiliary roll 7a and the roll 6a (FIG. 3), the belt stops its motion, the rear auxiliary roll 7b retracts, the front auxiliary roll 7a descends, the front blade base 16a retracts, the front cutter 12a returns, and the trucks 5 slide backward on the rails 4 as far as the rear ends of the rails and eventually force the front roll 6b of the guiding means to be positioned on the rear auxiliary roll 7b now resting in its retracted position (FIG. 4).

The exact time at which the cutter 12a cuts the present sheet may be selected so that the leading end of the next sheet covered by the adhesive tape and advanced together with the upper zone of the belt will be joined with the adhesive tape to the trailing end of the present sheet cut by the cutter 12a or to a slightly forward point of the sheet from the trailing end after the leading end has continued its advance and moves past the front end of the upper zone and the roller 3a'.

After the leading end of the next sheet has been joined through the adhesive tape to the trailing end of the present sheet as described above, the sheet is drawn out of the next sheet roll on the rear support means and the guiding means 6 is moved on the rails to the rear ends of the rails. Then, the sheet from the next sheet roll is threaded through the gap intervening between the rear auxiliary roll 7b and the front roll 6b of the guiding means and drawn out around the latter half of the circumference of the roll 6b (FIG. 4).

While the sheet is being drawn out of the next sheet roll on the rear support means 1b, the remaining spool of the present sheet roll is removed from the front support means 1a and a third sheet roll 17-III is set in place on the front support means 1a. The sheet 17-III' is manually pulled out of the sheet roll 17-III, and set in place on the upper zone of the belt from the front. The leading end of this sheet is covered with an adhesive tape 18 and set at the position P-a at a fixed distance L from the front end of the upper zone. The setting of the leading end of the sheet at the position P-a may be effected manually or mechanically as already pointed out.

For the leading end of the sheet from the sheet roll 17-III to be joined to the sheet 17-II' already drawn out as described above, the switch for the joining operation on the control panel for the sheet roll supported on the front support means must be turned ON. Consequently, the front auxiliary roll 7a moves backward and presses the sheet 17-III' against the roller 3a'. At the same time, the belt is set moving so that the upper zone will move backwardly. The sheet 17-III' rotates the sheet roll 17-III and is drawn out in the rearward direction. At this time, the rear blade base 16b is moved backwardly by the air cylinder 15 to oppose the receiving blade 13b to the cutter 12b (FIG. 5).

After the sheet 17-III' has moved backwardly to some extent in conjunction with the upper zone of the belt, the rear cutter 12b protrudes and cuts the sheet 17-II' in the direction of width in cooperation with the receiving blade 13b, the sheet 17-II' is drawn in through the gap between the rear auxiliary roll 7b and the roll 6b, the leading end of the third sheet 17-III' covered with the adhesive tape and moved backwardly together with the upper zone of the belt moves over the rear end of the upper zone and the roller 3b' and finally adheres with the adhesive tape to the trailing end of the second sheet 17-II'. The joint thus formed between the two sheet ends moves past the gap intervening between the rear auxiliary roll 7b and the roll 6b. At this time, the belt stops its motion, the front auxiliary roll 7a advances, the rear auxiliary roll 7b descends, the rear receiving blade base 16b and the rear cutter 12b return, and the trucks 5 move on the rails to the front ends of the rails and force the rear roll 6a of the guide means to be positioned on the front auxiliary roll 7a now resting in its forward position.

Then, as a result, the sheet is drawn out of the sheet roll which has been set in place on the front support means.

As described above, new sheet rolls are set in place alternately on the front support means and the rear support means and the leading end of a sheet from a second sheet roll is joined to the trailing end of a sheet from the first sheet roll so that a sheet will be supplied continuously to the machine in which the sheet is processed or treated as desired.

Figure 6A:
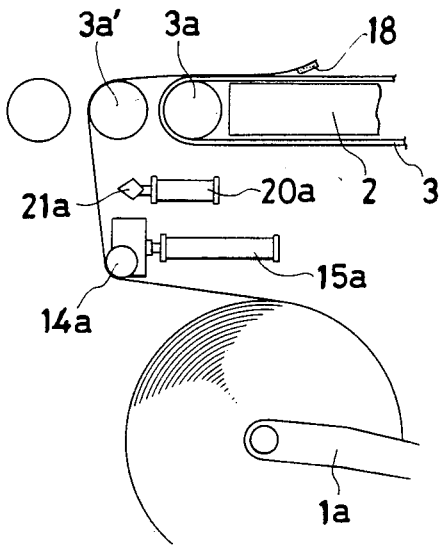
FIGS. 6(A) and 6(B) are explanatory diagrams illustrating the apparatus for treating the leading ends of sheets in their curled states.
Figure 6B:
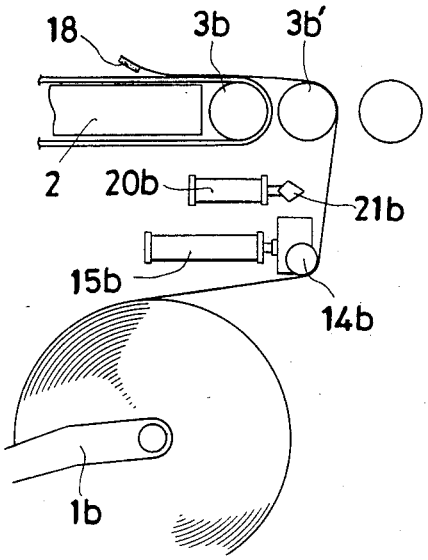

Generally sheet rolls come in two types; in one type, the sheet is wound with the front side thereof on the outside and, in the other type, the sheet is wound with the rear side on the outside. In either case, the leading end of the sheet pulled out of the sheet roll is curled owing to the tightness with which the sheet is kept rolled on the spool. When the leading end of the second sheet is placed on top of the upper zone 3' of the belt 3 for the purpose of joining the front or rear side of the second sheet to the front or rear side of the first sheet, the leading end of the sheet is warped downwardly or upwardly, depending on the curliness of the sheet (FIGS. 6A and 6B). When the leading end warps downwardly, no difficulty is entailed because it is placed substantially flatly on the upper zone 3' of the belt and, therefore, is allowed to flatten out under its own weight. When the leading end warps outwardly, this upward warp of the leading end of the sheet persists while the leading end remains on the upper zone 3'. When this leading end is moved past the end of the belt and brought near the trailing end of the first sheet by the motion of the belt, therefore, it floats up the surface of the belt and refuses to move together with the belt or advance straight in the direction of the gap between the auxiliary roll **7*a* and the roll 6*a* or between the roll 7*b* and the roll 6*b***. At times, this trouble can be so severe as to obstruct the union of sheet.

To preclude this trouble, decurlers **19*a*, 19*b* adapted to remove the curliness from the sheets are disposed similarly to the cutters 12*a*, 12*b* along the paths through which the sheets, drawn out of the sheet rolls held in place on the support means 1*a*, 1*b*, are advanced toward the front and rear ends of the table. The decurlers adopted for this embodiment comprise paired cylinders 20*a*, 20*b* secured as opposed to the laterally spaced stationary side boards 10 and correcting pieces 21*a*, 21*b*** formed of plates or angular bars and bridged between the leading ends of their respective pistons.

Figure 7:
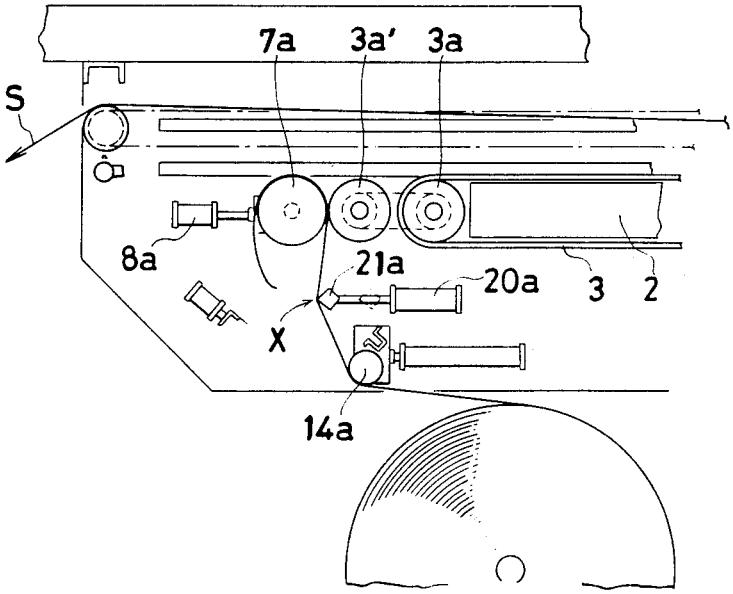
FIGS. 7 through 11 are explanatory diagrams illustrating the steps of the preparatory operation of the essential part of the splicer in the order.

When the leading end of a sheet pulled out of a new sheet roll which has been set in place on the support means **1*a* to 1*b* warps downwardly because of the curliness of the sheet when the leading end is set in place on the upper zone 3' of the belt 3, the auxiliary roll 7*a* or 7*b* corresponding to the thrust out of the cylinders of the decurlers to nip the leading end of the sheet in much the same way as described above, and the correcting piece 21*a* or 21*b* is pushed against the stretched web of the sheet to eliminate the curl or impart a curl X so that the leading end, when set on the upper zone of the belt, forms a curve of the shape of a hill (FIG. 7**).

Then, the correcting pieces of the decurlers are retracted and the belt is driven to a slight extent so that the leading end of the sheet will be passed over the auxiliary roll **7*a* or 7*b* and hung down as though it were folded back. The sheet is fed out until the portion of the sheet which has acquired the inclination to curl is suspended from the auxiliary roll. (During this period, the sheet can be suspended from the auxiliary roller as described above because the auxiliary roll presses the sheet against the roller 3*a*' or 3*b*' and the roller 3*a*' or 3*b*'** is rotated as interlocked with the pulley of the belt.)

Figure 8:
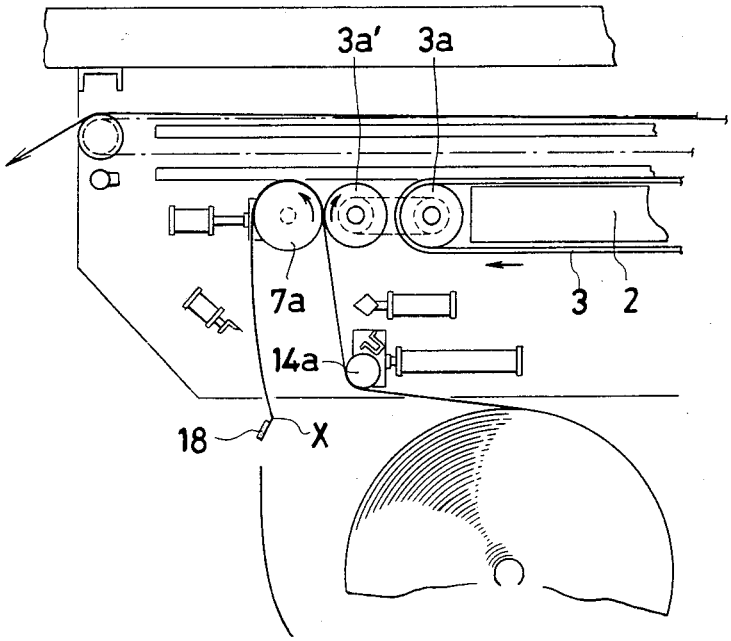
Figure 9:
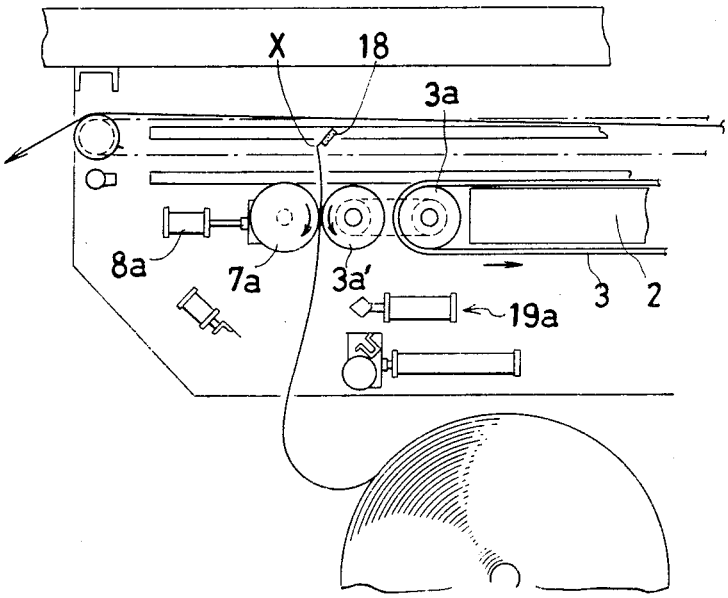
Figure 10:
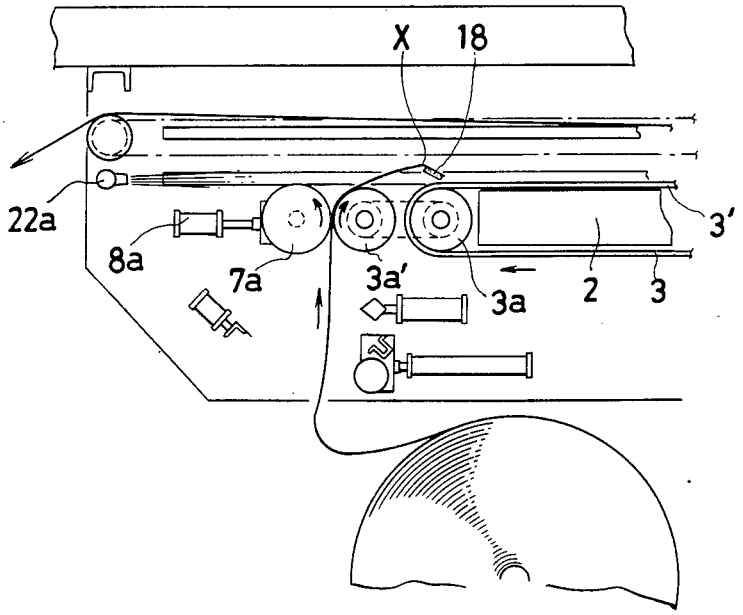
Figure 11:
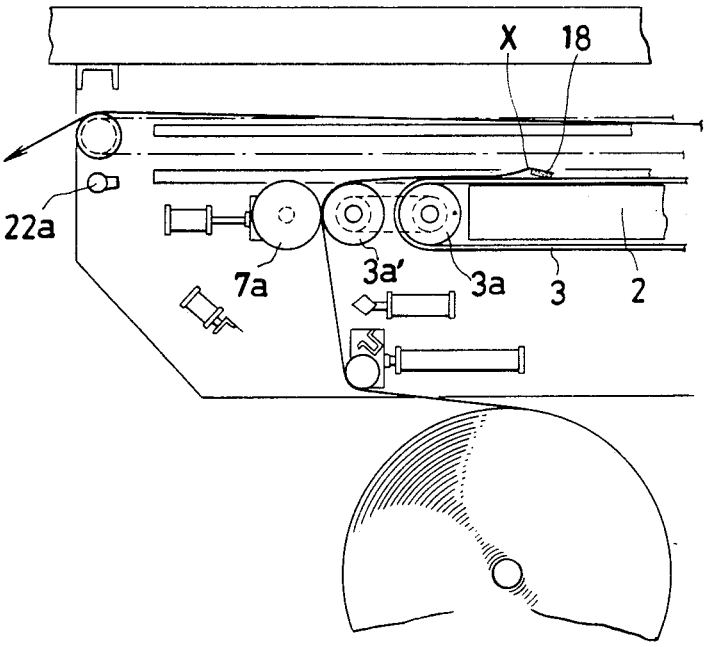

Then, the sheet is manually cut in the direction of width at a point immediately preceding the portion pushed by the decurlers and a double-faced adhesive tape 18 is applied to the cut end (FIG. 8). Subsequently, the belt is driven backwardly to return the sheet and the belt stopped when the leading end of the sheet is stands substantially upright from the portion nipped between the auxiliary roll and the roller **3*a*' or 3*b*'. Consequently, the portion of the sheet between the point at which the sheet is drawn out of the sheet roll and the point at which the sheet is nipped between the auxiliary roll and the roller 3*a*' or 3*b*' is slackened. Then, the belt is slightly driven to feed out the sheet and eliminate the slackness. Desirably, air is injected through a nozzle 22*a* or 22*b* against the leading end of the sheet so that the sheet deprived of the slackness and pushed out upwardly is laid down on the upper zone 3' of the belt 3 (FIG. 10). The belt is stopped when the leading end of the sheet reaches the position P-a or P-b at a fixed distance L from the front end or rear end of the upper zone. Thus, the leading end of the sheet is ready for union with the trailing end of the first sheet (FIG. 11). FIGS. 7 through 11 represent a case wherein the sheet roll is set in place on the front support means. The operation described hereinafter with reference to these diagrams similarly applies to the case wherein the sheet roll is set on the rear support means. In the latter case, however, the belt 3** is driven in the opposite direction.

The preparation for the union of sheet ends described above can be performed as advantageously when the leading end of the sheet set in place on the upper zone of the belt warps downwardly because of the curliness of the sheet as when the leading end warps upwardly. When the leading end warps downwardly, it offers no hindrance to the union of sheet ends because the curled leading end is substantially flattened out under the weight of the sheet as already pointed out. The procedure of using the correcting pieces of the decurlers to deprive the sheet of the downward warp and impart thereto a curl of the shape of a hill brings about a desirable result that the leading end clings fast to the belt and moves together with the belt while it is advanced on the belt in the direction of the trailing end of the first sheet.

When the operator depresses relevant switches so as to adjust suitably the degree by which the curled portion X of the sheet is allowed to hand down from the auxiliary roll by feeding out the sheet by the motion of the belt, the degree by which the sheet is retracted by the reverse motion of the belt after the sheet has been manually cut at a slightly forward point from the curled portion X and the adhesive tape has been attached to the cut end, and the degree by which the leading end of the sheet is allowed to reach the position P-a or P-b by again feeding out the sheet by the motion of the belt.

The union of sheet ends has been described as relying on the adhesive tape 18. This is not the only way in which the union can be attained by this invention. By the splicer of the present invention, this union may be obtained by applying to the leading end of the second sheet an adhesive agent capable of being activated under the influence of pressure in place of the adhesive tape, disposing means for activating the aforementioned adhesive agent along the path in which the sheet is advanced by the motion of the belt, allowing the adhesive agent on the leading end of the sheet to be activated by the aforementioned activating means, and enabling the leading end of the sheet to be joined to the trailing end of the first sheet by the activated adhesive agent. The guide means 6 has been described as comprising the two rolls **6*b*, 6*a* attached to the front and rear ends of the trucks 5. Alternatively, it may be formed of just one roll which is adapted so that it will assume its position directly above the auxiliary roll 7***a* when the trucks are in the advanced position and directly above the auxiliary roll 7*b* when the trucks are in the retracted position.

The present embodiment has been described as using the cutters 12*a*, 12*b* for the purpose of enabling the sheet from the first sheet roll to be cut at any desired position in the direction of width thereby allowing the leading end of the sheet from the second sheet roll to be joined to the aforementioned desired position of the sheet from the first sheet roll. Optionally, a photoelectric device adapted to detect the trailing end of the sheet from the first sheet roll (the end of the sheet directly wrapped around the spool) and issue a signal indicating this detection may be utilized in place of the aforementioned cutters so that the relevant switches will be automatically turned on to effect the union of sheet ends. Further, in place of the table, which is a plain slab having a smooth, flat top, there may be used a suction box having a porous suction surface on the upper side and a vacuum pump may be connected to the suction box with a pipe, so that after the sheet from the second sheet roll has been advanced in conjunction with the belt and readied to be joined to the trailing end of the sheet from the first sheet roll, the opposed sheet ends will be pulled down onto the suction box by having the ambient air drawn through the suction box toward the vacuum pump. In this case, the belt 3 is naturally required to be pervious to air.

As described in detail above, this invention provides a splicer for sheet ends, which comprises front and rear support means disposed as separated on the downstream side and the upstream side respectively in the direction of flow of the sheet and adapted to support in place two sheet rolls, one for immediate use and the other as a standby, a table having a smooth, flat top disposed above the two sheet rolls as held in place on the aforementioned support means, an endless belt laid so that the lower side of the upper zone thereof will come into sliding contact with the upper surface of the table and will produce a circular motion in both directions, and a sheet guiding means disposed above the upper zone of the belt and adapted to produce a reciprocation in parallel to the upper zone of the belt.

When this splicer is desired to be operated so that, while the sheet from the first sheet roll set in place on the front support means is being drawn out over the sheet guiding means moved in advance to the front end of the table, the sheet from the second sheet roll set in place on the rear support means may be pulled out and placed on the upper zone of the belt from behind so as to enable the leading end thereof to be kept at the prescribed position on the upper zone of the belt and then joined from behind to the sheet from the first sheet roll, this operation can be accomplished by causing the belt to be circularly driven to a fixed extent along the upper zone thereby enabling the sheet from the second sheet roll kept in place thereon beforehand to be advanced together with the belt, joining the leading end of this sheet to the sheet of the first sheet roll on the guiding means, and causing the sheet guiding means now guiding the joined sheet thereon to be moved in its original state to the rear end side of the table and brought to a stop thereon. When the splicer is desired to be operated so that, while the sheet from the sheet roll on the rear support means is being continuously drawn out and, in this while, the sheet from the third sheet roll set in place on the front support means in place of the first sheet roll is being placed on the upper zone of the belt from the front so as to enable the leading end thereof to be retained at the prescribed position on the upper zone from the front and then joined to the sheet from the second roll, the operation can be accomplished by causing the belt to be circularly driven to a prescribed extent so as to have the upper zone thereof moved backwardly thereby enabling the sheet kept in place thereon beforehand to be moved backwardly together with the belt, joining the leading end of the sheet on the guiding means to the sheet from the sheet roll held on the rear support means, subsequently moving the sheet guiding means to the front end side of the table, and continuing the drawing of the sheet from the sheet roll held on the front support means. When the sheets drawn out of the sheet rolls set in place on the front and rear support means happen to be such that the leading end of the sheet from the second sheet roll to be joined to the trailing end of the sheet from the first sheet roll is curled so much as to impair the union of the sheet ends, decurlers adapted to deprive the sheets of the curl are disposed one each in the paths through which the sheets drawn out of the respective sheet rolls advance toward the front and rear ends of the table. These decurlers serve to deprive the sheets of the curl so that the leading end of the sheet from the second sheet roll will be smoothly and safely connected to the trailing end of the sheet from the first sheet roll. Optionally, the rollers 3*a*', 3*b*' may be omitted and the auxiliarly rolls may be adapted so as to press the respective pulleys 3*a*, 3*b* through the medium of the belt.

Obviously, many modifications and variations of the present invention are possible in light of the above teachings. It is therefore to be understood that within the scope of the appended claims, the present invention may be practiced otherwise than as specifically described herein.

What is claimed is:

1. Sheet splicing apparatus, comprising:

a first sheet roll from which a first web of material is being unrolled and conveyed;

a second sheet roll, laterally spaced from said first sheet roll, from which a second web of material can be unrolled so as to have a leading edge portion thereof spliced to a trailing edge portion of said first web of material;

a first roll disposed within the vicinity of said first sheet roll;

second roll means disposed within the vicinity of said first sheet roll for rotatably cooperating with said first roll in defining a nip through which said trailing edge portion of said first web of material can be conveyed;

means provided upon said leading edge portion of said second web of material for permitting said leading edge portion of said second web of material to be secured to said trailing edge portion of said first web of material whereby said first and second webs of material can be spliced together; and means for transporting said leading edge portion of said second web of material from within the vicinity of said second sheet roll into said nip defined between said first and second rolls, disposed within the vicinity of said first sheet roll, whereby said leading edge portion of said second web of material is spliced to said trailing edge portion of said first web of material within said nip defined between said first and second rolls by said securing means provided upon said leading edge portion of said second web of material as said trailing edge portion of said first web of material and said leading edge portion of said second web of material pass through said nip defined between said first and second rolls disposed within said vicinity of said first sheet roll.

2. A sheet splicer according to claim 1, wherein:

said second roll means comprises two rolls adapted to rotate in opposite directions relative to the flow of the first web of material therethrough.

3. Apparatus as set forth in claim 1, wherein:

said securing means comprises double-sided adhesive tape.

4. Apparatus as set forth in claim 1, wherein:

said transporting means comprises a conveyor belt.

5. Apparatus as set forth in claim 4, further comprising:

table means disposed above said first and second sheet rolls; and said conveyor belt is an endless belt disposed about said table so as to have a lower zone disposed beneath said table and a upper zone disposed atop said table so as to be supported by the upper surface of said table while transporting said leading edge portion of said second web of material from within said vicinity of said second sheet roll to said nip defined between said second roll means and said first roll disposed within the vicinity of said first sheet roll.

6. A sheet splicer according to claim 4, wherein:

sheet cutters are disposed one each between said sheet rolls and the front and rear ends of said belt.

7. Apparatus as set forth in claim 1, further comprising:

support means; and support arms projecting outwardly from opposite sides of said support means for rotatably supporting said first and second sheet rolls upon said support means.

8. A sheet splicer according to claim 7, wherein:

sheet cutters are disposed one each between said sheet roll support means and the front and rear ends of said transport means.

9. A sheet splicer according to claim 7, wherein:

decurlers adapted to remove curliness from sheets are disposed along the paths through which the sheets, drawn out of said sheet rolls held in place on said support arms, are advanced toward said first and second rolls, and said transport means, so as to enable said sheets to be effectively conveyed by said transport means.

10. Sheet splicing apparatus, comprising:

a first sheet roll from which a first web of material is being unrolled and conveyed;

a second sheet roll from which a second web of material can be unrolled so as to have a leading edge portion thereof spliced to a trailing edge portion of said first web of material when said first web of material disposed upon said first sheet roll is about to be depleted;

a first roll disposed within the vicinity of said first sheet roll;

a second roll disposed within the vicinity of said second sheet roll;

roller means cyclically movable between said vicinity of said first and second sheet rolls for cyclically cooperating with said first and second rolls in defining a first nip through which said trailing edge portion of said first web of material can be conveyed upon nearing depletion thereof, and a second nip through which a trailing edge portion of said second web of material can be conveyed upon nearing depletion thereof;

adhesive means provided upon said leading edge portion of said second web of material for permitting said leading edge portion of said second web of material to be secured to said trailing edge portion of said first web of material whereby said first and second webs of material can be spliced together; and cyclically movable conveyor belt means for transporting said leading edge portion of said second web of material from within the vicinity of said second sheet roll into said first nip defined between said roller means and said first roll disposed within said vicinity of said first sheet roll whereby said leading edge portion of said second web of material is spliced to said trailing edge portion of said first web of material within said nip defined between said roller means and said first roll by said adhesive means provided upon said leading edge portion of said second web of material, and for transporting a leading edge portion, having adhesive means thereon, of a third web of material disposed upon a third sheet roll, which has replaced said first sheet roll upon said depletion thereof, from within the vicinity previously containing said first sheet roll into said second nip defined between said roller means and said second roll disposed within said vicinity of said second sheet roll whereby said leading edge portion of said third web of material is spliced to said trailing edge portion of said second web of material within said nip defined between said roller means and said second roll by said adhesive means provided upon said leading edge portion of said third web of material.

11. Sheet splicing apparatus as set forth in claim 10, wherein:

said roller means comprises a pair of rolls adapted to rotate in opposite directions relative to the flow of said first and second webs of material therethrough.

12. Apparatus as set forth in claim 11, further comprising:

truck means for fixedly mounting said pair of rolls thereon; and rail means extending between said vicinities of said first and second sheet rolls for guiding said truck means between said vicinities of said first and second sheet rolls during said cyclical movement of said roller means.

13. A sheet splicer according to claim 12, wherein:

said truck means are adapted to be driven by chain members passed around pulleys disposed at the front and rear ends of said rail means.

14. Apparatus as set forth in claim 10, further comprising:

reversible drive means for cyclically driving said conveyor belt means in opposite directions between said vicinities of said first and second sheet rolls.

15. A sheet splicing system, comprising:

support means;

means rotatably mounting a first sheet roll, from which a first web of material is being unrolled, upon one end of said support means;

means rotatably mounting a second sheet roll, from which a second web of material can be unrolled so as to have a leading edge portion thereof spliced to a trailing edge portion of said first web of material when said first web of material disposed upon said first sheet roll is about to be depleted, upon a second end of said support means;

a first roll disposed within the vicinity of said first sheet roll;

a second roll disposed within the vicinity of said second sheet roll;

roller means cyclically reciprocable between said vicinities of said first and second sheet rolls for cyclically cooperating with said first and second rolls in defining a first nip through which said trailing edge portion of said first web of material can be conveyed upon nearing depletion thereof, and a second nip through which a trailing edge portion of said second web of material can be conveyed upon nearing depletion thereof;

adhesive means provided upon said leading edge portion of said second web of material for permitting said leading edge portion of said second web of material to be secured to said trailing edge portion of said first web of material whereby said first and second webs of material can be spliced together;

a third sheet roll, to be mounted upon said one end of said support means for replacing said first sheet roll when said first sheet roll in depleted, from which a third web of material can be unrolled so as to have a leading edge portion thereof which can be spliced to said trailing edge portion of said second web of material when said second web of material disposed upon said second sheet roll is about to be depleted;

adhesive means provided upon said leading edge portion of said third web of material for permitting said leading edge portion of said third web of material to be secured to said trailing edge portion of said second web of material whereby said second and third webs of material can be spliced together; and cyclically reversible conveyor belt means for transporting said leading edge portion of said second web of material from within the vicinity of said second sheet roll into said first nip defined between said roller means and said first roll disposed within said vicinity of said first sheet roll whereby said leading edge portion of said second web of material is spliced to said trailing edge portion of said first web of material within said nip defined between aaid roller means and said first roll by said adhesive means provided upon said leading edge portion of said second web of material, and for transporting said leading edge portion of said third web of material from within the vicinity of said one end of said support means into said second nip defined between said roller means and said second roll disposed within said vicinity of said second sheet roll whereby said leading edge portion of said third web of material is spliced to said trailing edge portion of said second web of material within said second nip defined between said roller means and said second roll by said adhesive means provided upon said leading edge portion of said third web of material.

16. A system as set forth in claim 15, wherein:

said adhesive means provided upon said leading edge portions of said second and third webs of material comprises doublesided adhesive tape.

17. A system as set forth in claim 15, further comprising:

reversible drive means for cyclically driving said conveyor belt means in opposite directions between said vicinities of said first and second sheet rolls.

18. A system as set forth in claim 15, further comprising:

cutter means interposed between said first and second sheet rolls, and said first and second rolls, for forming said trailing edge portions of said first and second webs of material.

19. A system as set forth in claim 15, further comprising:

table means interposed between said first and second rolls; and said conveyor belt means comprises an endless belt disposed about said table so as to have a lower zone disposed beneath said table and an upper zone disposed atop said table so as to be supported by the upper surface of said table while transporting said leading edge portions of said second and third webs of material to said nips defined between said roller means and said first and second rolls.

20. A system as set forth in claim 19, wherein:

rail means disposed above said table means for mounting said roller means thereon so as to permit reciprocation of said roller means between said vicinities of said first and second sheet rolls.

* * * * *